United States Patent [19]

Evans

[11] 4,093,908

[45] June 6, 1978

[54] PHASE-CONTROLLED VOLTAGE REGULATOR

[75] Inventor: William C. Evans, Rochester, N.Y.

[73] Assignee: Viva-Tech Inc., Rochester, N.Y.

[21] Appl. No.: 722,632

[22] Filed: Sep. 13, 1976

[51] Int. Cl.[2] ..... G05F 3/04

[52] U.S. Cl. ..... 323/19; 323/24; 323/34

[58] Field of Search ..... 323/16, 19, 22 SC, 24, 323/34

[56] References Cited

U.S. PATENT DOCUMENTS

| | | | |
|---|---|---|---|
| 3,532,855 | 10/1970 | Vancleave | 323/24 X |
| 3,564,388 | 2/1971 | Nolf | 323/22 SC |
| 3,935,530 | 1/1976 | Tanaka et al. | 323/24 X |

*Primary Examiner*—A. D. Pellinen

*Attorney, Agent, or Firm*—Warren W. Kurz

[57] ABSTRACT

A method and apparatus for regulating the RMS voltage applied to a load from an AC source having a peak-to-peak amplitude which varies within a predefined range. The apparatus comprises a waveform generator for producing a predefined periodic waveform, a comparator circuit for comparing such waveform with the sinusoidal waveform of the source whereby a signal is produced each time the algebraic difference between the instantaneous values of the compared waveforms changes sign, and a switching circuit responsive to the comparator circuit output for interrupting the voltage applied to the load at the start of each cycle or half-cycle. The shape of the waveform produced by the waveform generator is such that the desired RMS voltage appearing at the output terminals is produced.

17 Claims, 10 Drawing Figures

A C POWER SOURCE
54
34
35
b
c
h
i
n 41
b
c
h
i
n 58
25
57
a
b
c
d
e
f
g
h
i
j
k
l
m
n

VOLTAGE COMPONENT PRODUCED BY R 15
c
e
i
k

PHASE-CONTROLLED VOLTAGE REGULATOR

BACKGROUND OF THE INVENTION

This invention relates to voltage regulating apparatus for accurately controlling the root-means-square (RMS) voltage applied to a load. More particularly, this invention relates to improvements in voltage regulating circuitry whereby the RMS output voltage can be maintained substantially constant even during rapid changes in the AC line voltage.

For many applications, it is desirable to maintain the RMS voltage applied to a load as constant as possible notwithstanding wide and rapid variations in the AC power line voltage. In the field of photographic printing, for instance, the voltage applied to the filament of the printing lamp is an extremely critical parameter in the printing operation, for even relatively small changes in the applied voltage applied to the lamp can produce very noticeable results in print quality. Particularly, when the exposure times are short, it is important that any voltage regulating apparatus used to control the lamp voltage be capable of compensating for rapidly occurring variations in line voltage (e.g. occurring within one-half cycle). Such rapid variations typically result from short-lived power surges and transients occurring on the power line voltage.

Generally speaking, voltage regulator devices heretofore have been incapable of responding fast enough to compensate for substantial variations in line voltage occurring within a half-cycle of the line voltage frequency. Some of the faster regulators depend upon the generation of DC signals representative of the average value or the peak value of either the AC line voltage or the load voltage or various combinations of each. Although regulators dependent on the generation of DC signals display somewhat faster response than most regulators, they still have a serious limitation in their ability to respond rapidly to changes in the AC power line voltage. This is because the rectifying and filtering networks required to produce the DC signals cannot respond instantaneously to rapid changes in the AC power line voltage. Attempts to reduce time constants in these networks and thereby improve the speed of response often result in a degradation of the linearity of the regulator. Thus regulators of this type are often characterized by poor transient response and good linearity or vice versa.

In addition to the relatively slow response which is characteristic of conventional voltage regulators, many of these use unipolarity signals to trigger a phase controlled switch (e.g. a triac) which serves to synchronously switch the voltage applied to the load. Such regulators require relatively large currents for reliable triggering.

SUMMARY OF THE INVENTION

In view of the above, an object of this invention is to provide a root means square voltage regulator which will both maintain the RMS output voltage substantially constant over a wide range of input AC power line voltage and will also rapidly correct for sudden changes in the AC power line voltage.

Another object of this invention is to provide a voltage regulator which protects an electrical load from undesirable current surges which are characteristically associated with the initial application of power to the load.

A further object of this invention is to provide voltage regulating circuitry in which bipolarity signals are used to trigger a phase-controlling switching element.

The above objects, as well as the advantages of the invention, are achieved by circuitry which includes a waveform generator which generates a particular predetermined time variant function, a comparator circuit which compares the output of the waveform generator with the instantaneous value of the AC power supply being regulated, and a switching circuit which interrupts the output of the AC source at the beginning of each cycle or half-cycle in response to a change in polarity of the comparator output. The comparator output changes state at the instant the alegebraic difference of the two input signals changes sign. The switching circuit then conducts until the current through the load is zero at which time it reverts to a non-conducting state and remains in this state until it is again caused to conduct by the comparator. The operation of the various portions of the regulator and the particular function or waveform generated by the waveform generator are such that the desired RMS voltage appearing at the output terminals is produced.

The invention will now be described with particular reference to a preferred embodiment thereof, reference being made to the accompanying drawings in which like reference characters designate like parts.

BRIEF DESCRIPTION OF DRAWINGS

FIG. 3 is an electrical schematic diagram illustrating the preferred circuitry of the invention;

DETAILED DESCRIPTION OF THE PREFERRED EMBODIMENT

Figure 1:
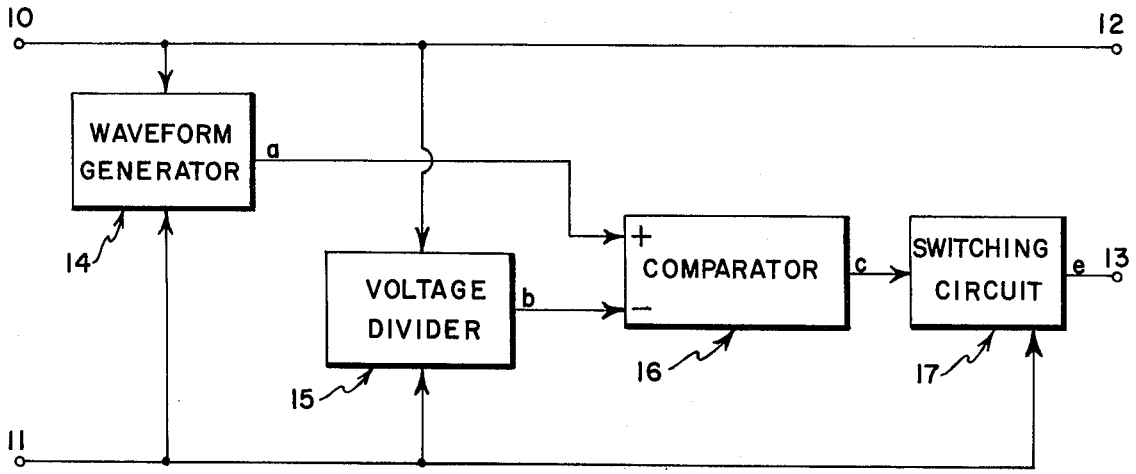
FIG. 1 is a block diagram of a voltage regulator constructed according to a preferred embodiment of the invention.

Referring now to FIG. 1, an RMS voltage regulator structured in accordance with the invention is shown to include a pair of input terminals 10 and 11 which are adapted to be connected across the AC power source requiring regulation, and a pair of output terminals 12 and 13 which are adapted to be connected across a load which is to receive a regulated RMS voltage. Between these input and output terminals, there is connected (in the manner hereinafter described) a waveform generator 14, a voltage divider 15, a comparator circuit 16 and a switching circuit 17. The latter comprises a capacitor C1, a resistor R1, and a conventional triac Q2. (See FIG. 3). The waveform generator 14 and the voltage divider 15 are connected in parallel across the source of AC power, and each produces a predetermined time variant output, *a* and *b*, respectively. Outputs *a* and *b* serve as the two inputs to comparator 18, whose output *c* changes state whenever the algebraic difference of the two input signals changes sign. The rapid change in the output of the comparator causes a current pulse to flow through capacitor C1 and resistor R1 to the gate terminal of triac Q2. As is well known by those skilled in the art, a triac is an AC semiconductor switch which may be triggered into conduction by means of its gate terminal. Once triggered, the triac remains in its conducting state until the current through it reaches zero, at which point the triac returns to its blocking or non-conductive state until it is again triggered into conduction.

Figure 2A:
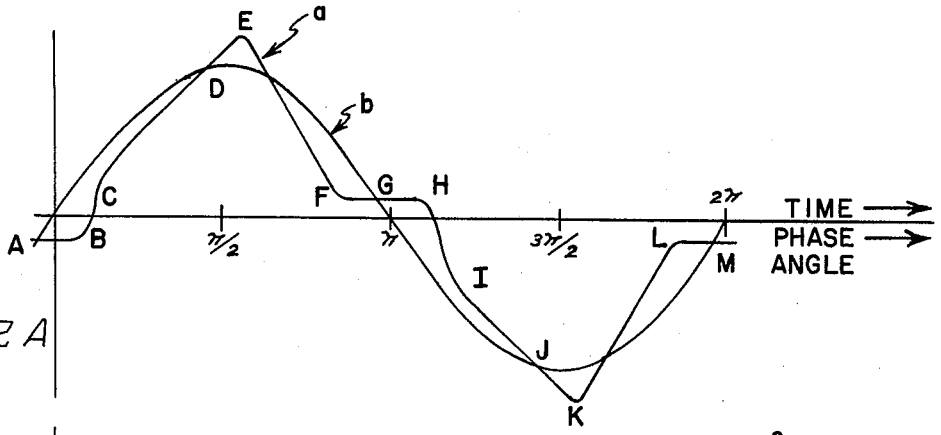
FIGS. 2A-2D are timing diagrams illustrating various waveforms of signals shown in FIG. 1.

An understanding of the operation of the voltage regulator depicted in FIG. 1 will be facilitated by referring to FIGS. 2A–2D in which the waveforms of the aforementioned outputs *a, b* and *c* are shown. Referring specifically to FIG. 2A, output *b* of voltage divider 15 is a sine wave which, of course, has an amplitude which is instantaneously proportional to the power source. Output *a* of waveform generator 14 is an irregular, but periodic, waveform, a preferred shape being depicted in FIG. 2A. In the region A-B, the output is clamped at a slightly negative potential. At point B, it rapidly rises to point C in a step-wise fashion. In region C-D-E, the function is nearly a linear ramp function. At point E, the waveform changes slope in region E-F and rapidly decreases to a new clamped level F-G-H which is now slightly positive. On the negative half-cycle of the AC power source, the output of the waveform generator is substantially identical to that of the positive half-cycle of the AC power source, except it is of opposite polarity.

Figure 2B:
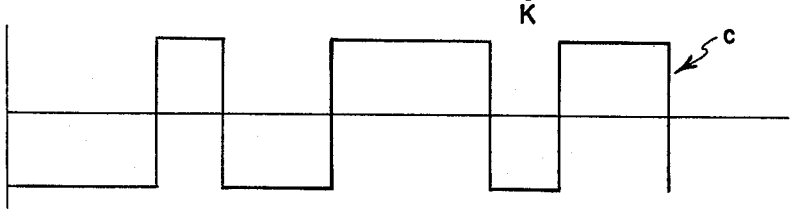
Figure 2C:
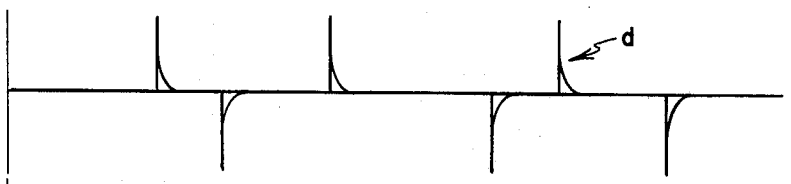
Figure 2D:
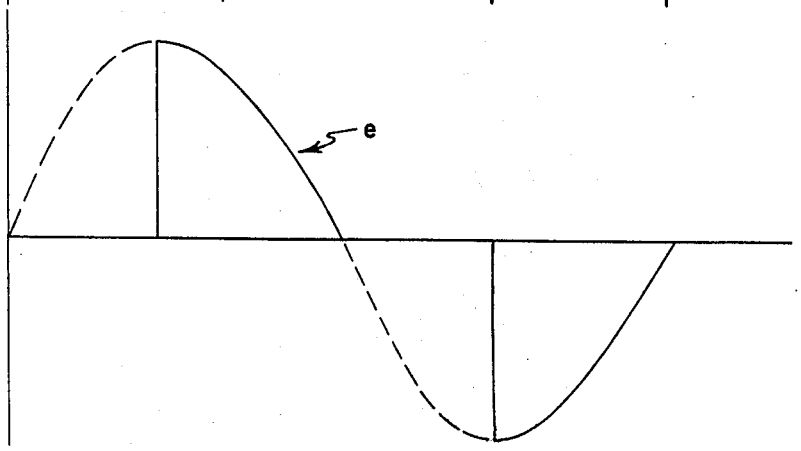
Figure 8:
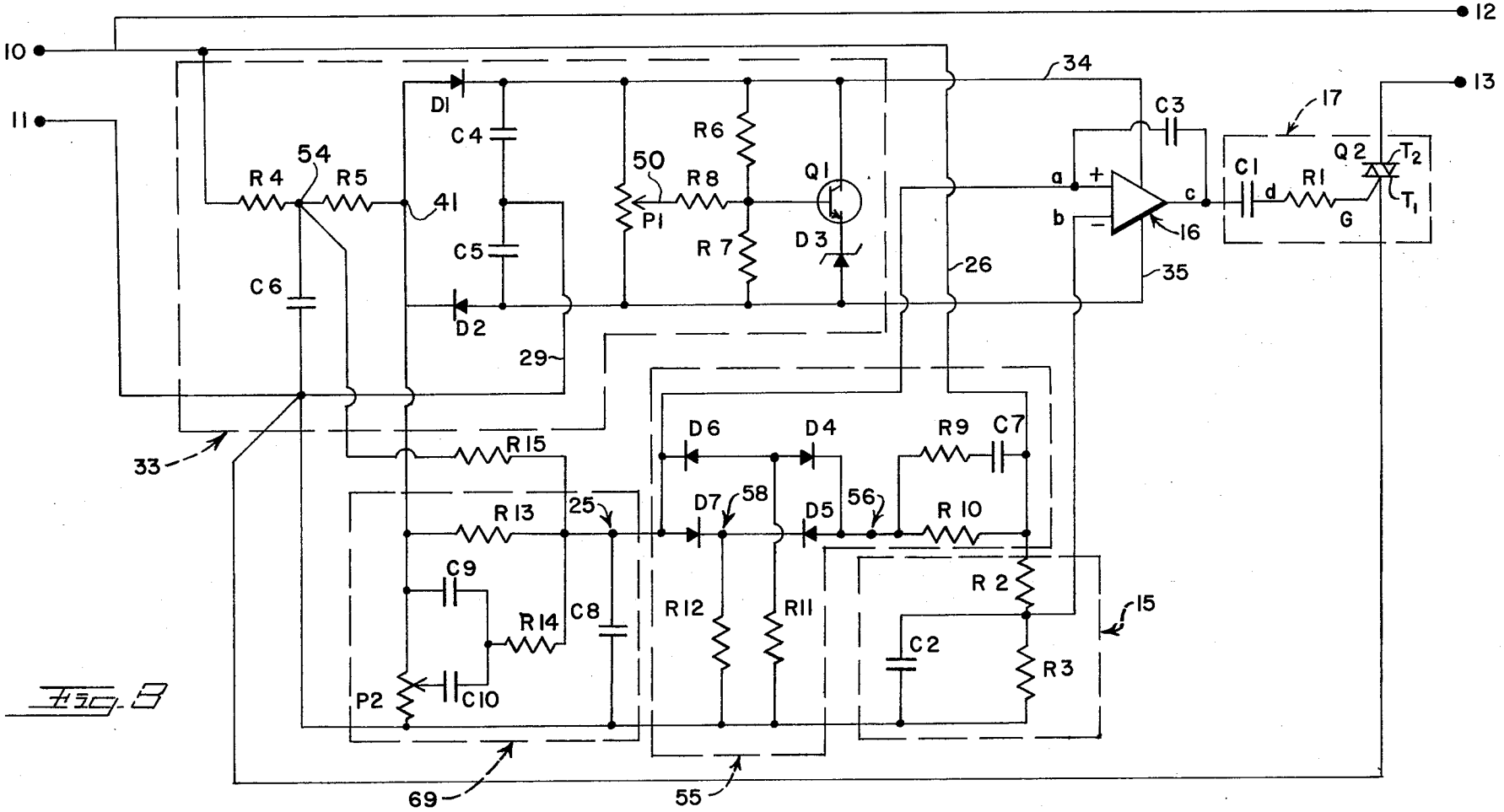

The output *c* of comparator 16 is shown in FIG. 2B. As will be appreciated by those skilled in the art, the output of the comparator will be positive when the signal at its positive terminal (i.e. output *a* of waveform generator 14) is positive with respect to the signal at its negative terminal (i.e. output *b* of voltage divider 15). Similarly, the output of the comparator will be negative when the signal at its positive terminal is negative with respect to the signal at its negative terminal. Referring to FIG. 2A, output *c* of the comparator is negative in the region A-B-C-D. At point D, the comparator output switches from negative to positive, generating a positive current pulse through capacitor C1 and resistor R1, thereby triggering the triac into conduction. Assuming that the load across terminals 12 and 13 is purely resistive, the triac will continue to conduct until the load current and voltage reach zero at a point between G and H. In the region E-F-G, the comparator output changes state twice but this has no effect since the triac has already been triggered into conduction. Since output *a* returns to a positive clamp position at point G, the comparator output goes to a positive state before the zero crossing of the power source. Hence, at the beginning of the negative half-cycle of the power source, the output of the comparator is in a positive state opposite from that at the beginning of the positive half-cycle of the power source. On the negative half-cycle of the power source, the waveforms are identical to those for the positive half-cycle except that they are reversed in polarity. Thus, the output voltage *e* shown in FIG. 2D will appear at the output terminals 12 and 13.

The manner in which regulation is achieved can now be seen by referring to the waveforms in FIGS. 2A–2D. As the line voltage decreases, the amplitude of the voltage divider output *b* decreases, causing the switching points D and J to move closer to points C and I, respectively. Movement of the switching points in this direction causes the triac to be triggered earlier on both the positive and negative half-cycles of the power source, causing the RMS voltage applied to the load to remain constant. Similarly, as the line voltage increases the amplitude of voltage divider output *b* increases, thereby causing switching points D and J to move closer to points E and K, respectively. Such movement causes the triac to be triggered later on both the positive and negative half-cycles of the power source, again causing the RMS voltage applied to the load to remain substantially constant. That region of waveform *a* on which switching occurs (i.e. portions C-E and I-K) is shaped so that the output voltage remains constant even though the amplitude of the AC power source varies over a wide range. As indicated above, it has been found that this region of the waveform is substantially linear, and its exact shape can be determined by merely plotting the phase angles (at which triac Q2 must be triggered) in order to maintain the RMS voltage at a desired constant. For instance, if the RMS voltage is to be maintained at 100 volts as the RMS line voltage varies between 110 and 130 volts, the shape of region C-D-E will be defined by the line connecting the points on each sinusoidal waveform of a family of such waveforms having an RMS value between 110 and 130 volts at which the phase angle of interruption would produce 100 volts RMS.

The shape of the switching regions (C-E and I-K) is the most critical part of waveform *a*. The remaining portions of this waveform can have virtually any shape, so long as the output of the comparator is of a polarity suitable for triggering the triac when it is required to do so (i.e. at the appropriate time, the comparator output must be positivegoing for the positive half-cycle of the AC power source, and negative-going for the negative half-cycle of the source). Other factors to bear in mind in designing circuitry to achieve this waveform are: (1) cost, and (2) the instantaneous value at any point should differ from the sinusoidal waveform so that inadvertent noise on the waveform does not produce false triggering of the triac. In the specific waveform generator circuit to be described with reference to FIG. 3, cost was a major factor in deciding to shape region E-F as shown in FIG. 2A (rather than to connect points E and I directly with a ramp-type function), and the desirability of eliminating false triggering was a major factor contributing to the shaping of regions A-B-C and G-H-I as shown in FIG. 2A.

It can also be seen from FIG. 2A that the switching points D and J occur when the instantaneous value of output *a* is substantially equal to the instantaneous value of output *b*. Also, the output *a* returns to a clamped position subsequent to switching. This in effect resets the regulator to a fixed set of reference conditions prior to the beginning of each half-cycle of the power source. Hence, if the power source should change rapidly, correction for this change will occur within one half cycle of the power source. For example, a change that occurs after the switching point D on the positive half-cycle of the power source will be corrected for at the switching point J on the negative half-cycle of the power source.

As is well known to those skilled in the art, a triac can be triggered into conduction in any one of four operating modes as summarized below (all polarities are taken with terminal $T_1$ as the point of reference):

| Operating Quadrant | $V_g$ | $V_{T_2}$ |
|---|---|---|
| I | + | + |
| II | − | + |
| III | − | − |
| IV | + | − |

Where $V_g$ is the potential at the gate terminal and $V_{T_2}$ is the potential at terminal $T_2$ of the triac.

The gate triggering requirements are different in each of these four quadrants; however most triacs are most sensitive in Quadrants I and III. That is, a smaller amount of triggering current is required in Quadrant I than in Quadrant II when $V_{T_2}$ is positive; and a smaller amount of triggering current is requires in Quadrant III than in Quadrant IV when $V_{T_2}$ is negative. As is shown in FIG. 2A–2D, the voltage and current waveforms produced by the comparator cause triac triggering in the most favorable quadrants, i.e. Quadrants I and III. This has numerous advantages, including the capability to trigger relatively high current capacity triacs, which normally require higher trigger currents in all quadrants, with relatively low power circuitry. This in turn reduces the cost and complexity of the circuit required to trigger the triac.

The reasons for generating the particular waveform *a* can also be seen by a closer observation of FIG. 2A. In the region A-B-C, the output of the waveform generator must always remain more negative than the output of the voltage divider for all possible values of line voltage. If it did not, the triac would be falsely triggered in the region A-B-C rather than in the active switching region C-D-E. I have found that the waveform required in the region C-D-E is a nearly linear ramp function, and that any appreciable curvature in this region due to the exponential characteristics of passive circuit components will produce a non-linearity in the regulation characteristic. Once switching has occurred, the output *a* must return to a positive clamped position such that the comparator output is set at the proper state before the current in the triac drops to zero. Otherwise, the triac would be falsely triggered near the beginning of the next half cycle of the power source. Clearly, an identical set of waveform criteria are required for the negative half cycle of the power source except for polarity reversal. While the waveform described characterizes the preferred embodiment, other waveforms which meet these general criteria may be used to produce the desired results.

The detailed operation of the regulator circuitry may be best understood by referring to the complete schematic in FIG. 3. The voltage divider is formed by resistors R2 and R3. Capacitor C2 in combination with these resistors provides a small amount of filtering to smooth out spurious transients in the output of the voltage divider 15. Output *b* of the voltage divider is fed to the negative input of the comparator as previously described.

With the exception of the aforementioned components which comprise voltage divider 15, comparator 16 and switching circuit 17, the remaining circuitry of FIG. 3 comprises the waveform generator 14.

The network, designated as 33 in FIG. 3, is a combination dual regulated power supply and a symmetrical square wave generator with adjustable amplitude. This network firstly produces two DC voltages of substantially equal magnitude but opposite in polarity with respect to circuit common lead 29. In the preferred embodiment, DC voltages of approximately +10 volts and −10 volts are produced on leads 34 and 35, respectively. These voltages form the plus and minus power supply voltages for an operational amplifier 36 which is wired as a differential comparator. Capacitor C3 is connected from the amplifier output to the positive input terminal to provide positive feedback to improve the switching characteristic. On the positive half cycle of the AC power source, capacitor C4 is charged to a positive DC potential with respect to circuit common through resistors R4 and R5 and diode D1, which conducts whenever the instantaneous voltage at point 41 is more positive than the voltage on capacitor C4. In the same manner, capacitor C5 is charged to a negative DC potential through the same resistors R4 and R5 and diode D2, which conducts whenever the instantaneous voltage at point 41 is more negative than the voltage on capacitor C5. Hence on alternate half cycles of the power source, substantially equal and opposite voltages are produced on capacitors C4 and C5. Resistors R6 and R7, transistor Q1 and zener diode D3 acting in combination with resistors R4 and R5 form a regulating means so that the DC voltages appearing on leads 34 and 35 are held substantially constant even though the magnitude of the AC power source may vary considerably. A portion of the total power supply voltage appearing across leads 34 and 35 is fed back to the base of transistor Q1 through a voltage divider formed by resistors R6 and R7. Zener diode D3 connected to lead 35 and to the emitter of transistor Q1 produces a DC voltage at the emitter of transistor Q1 which is positive with respect to lead 35, and which is substantially constant since the voltage across the zener diode is substantially independent of the current flowing through it. A current path from lead 34 to lead 35 formed by transistor Q1 and zener diode D3, acting in combination with resistors R4 and R5, serves to control the voltage level to which capacitors C4 and C5 will charge during each alternate half cycle of the power source. If the current through this current path is increased, the capacitors will charge to lower voltages and vice versa. Having once reached steady state, if the line voltage should for example increase, the voltage at the base of transistor Q1 would tend to go more positive with respect to the emitter. This in turn would tend to cause the current through transistor Q1 and zener diode D3 to increase which in turn would tend to reduce the DC power supply voltages on leads 34 and 35. Hence voltages which are substantially equal in magnitude but opposite in polarity with respect to circuit common are produced on leads 34 and 35, and further the voltages are held substantially constant even though the magnitude of the AC power source may vary considerably.

Potentiometer P1 and resistor R8 provide a means for adjusting the magnitude of the two DC voltages on leads 34 and 35. The two ends of potentiometer P1 are connected across the total power supply output on leads 34 and 35, while the slider of the potentiometer is connected to one end of resistor R8; the other end of resistor R8 is connected to the base of transistor Q1. As the slider of potentiometer P1 is moved from one end to the other, the DC voltage at point 50 with respect to the voltage on the base of transistor Q1 is varied, and the current flowing through resistor R8 is varied. This current adds to or substracts from the current flowing to the base of transistor Q1 via resistors R6 and R7, and thereby causes the current flowing through the transistor and the zener diode to either increase or decrease. By means described earlier, if the transistor current increases, the voltage on leads 34 and 35 with respect to circuit common decrease and vice versa. The regulating action described previously, however, continues. Thus, adjustment of potentiometer P1 changes the magnitude of the output voltage on leads 34 and 35, but these voltages remain substantially equal in magnitude but opposite in polarity with respect to circuit common.

The DC voltages on leads 34 and 35 also remain substantially constant over a wide range of ambient temperature. The base-emitter voltage of transistor Q1 exhibits a negative temperature coefficient which would normally cause the output voltages on leads 34 and 35 to change as a function of temperature. In the preferred embodiment, this effect has been compensated for, however, by selecting a zener diode D3 with a positive coefficient of such magnitude as to exactly compensate for the temperature effects of transistor Q1. Thus the output DC voltages on leads 34 and 35 remain substantially constant even though the temperature may vary over a considerable range.

The network, designated 33 in FIG. 3, also produces a phase shifted symmetrical square wave of adjustable amplitude which appears at point 41. As will be explained later, this waveform is utilized in the generation of the waveform at point 25. Referring again to FIG. 3, resistor R4 and capacitor C6 form a phase shift network such that the voltage at point 54 is sinusoidal but lagging the AC power source. This voltage appears at one end of resistor R5; the other end of resistor R5 being connected to point 41. The manner in which the waveform at point 41 is produced can now be seen by referring to FIGS. 4A and 4B. In the region, *b-c* both diodes D1 and D2 are back biased in their non-conducting state because of the voltages on capacitors C4 and C5. In this region, the voltage at point 41 is nearly equal to the voltage at point 54 since the impedance of circuitry attached to point 41 is relatively high compared to the resistance of resistor R5. At point *c*, the voltage at point 41 is slightly more positive than the voltage on lead 34 and is sufficient to cause diode D1 to conduct. Once diode D1 conducts, the voltage at point 41 is clamped at the voltage on lead 34 and remains there until point *h* in the cycle is reached. At this point, diode D1 ceases conducting. Both diodes D1 and D2 remain in their non-conducting states in the region *h-i*, and the voltage at point 41 is again nearly equal to the voltage at point 54. At point *i* in the cycle, the voltage at point 41 is slightly more negative than the voltage on lead 35, and is sufficient to cause diode D2 to conduct. Once diode D2 conducts, the voltage at point 41 is clamped at the voltage on lead 35 and remains there until point *n* in the cycle is reached, at which point diode D2 ceases to conduct. Hence a square wave whose phase angle is lagging that of the AC power source is produced at point 41. (See FIG. 4B) Because of the clamping action of diodes D1 and D2, the positive amplitude of the square wave is nearly equal to the positive power supply voltage appearing on lead 34; while the negative amplitude of the square wave is nearly equal to the negative power supply voltage appearing on lead 35. Since these two voltages are equal in magnitude but of opposite polarities with respect to circuit common, the square wave is symmetrical in that its positive and negative portions are identical but of opposite polarity. It also follows that the peak-to-peak value of the square wave at point 41 remains substantially constant even though the amplitude of the AC source and the temperature may vary over a considerable range. Further, if the magnitude of the DC voltages on leads 34 and 35 vary for any reasons, then the peak-to-peak amplitude of the square wave at point 41 will also vary in accordance with these voltages. For example, if the DC voltages on leads 34 ad 35 are varied by means of potentiometer P1 as previously described, then the peak-to-peak amplitude of the square wave at point 41 will also vary. Hence, potentiometer, P1 may be used directly to adjust the amplitude of the square wave appearing at point 41.

Figures 4A, 4B, 4C, 4D:
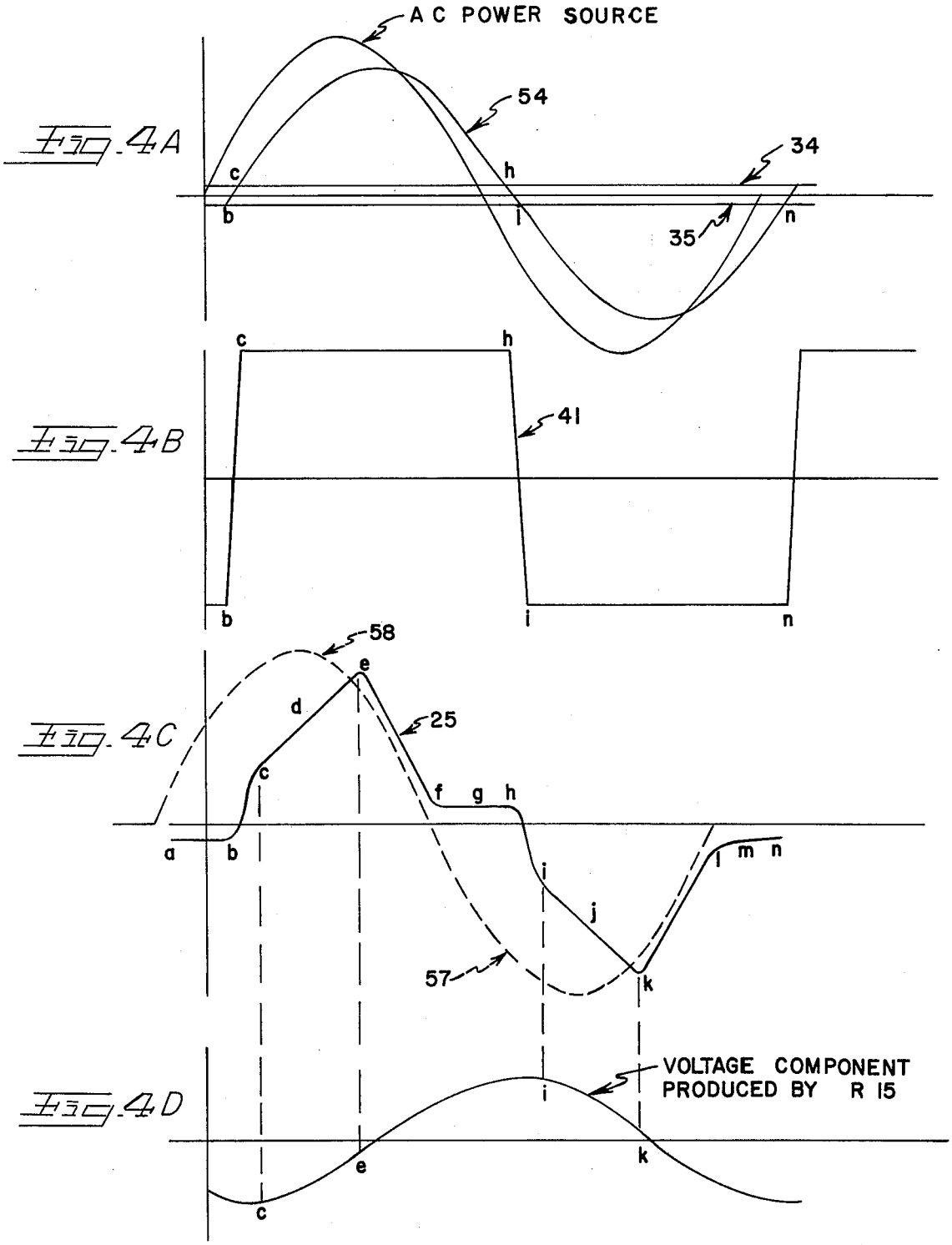
FIGS. 4A-4D are timing diagrams illustrating various waveforms in the preferred circuitry of FIG. 3 and the inter-relationship thereof.

The method by which the waveform at point 25 is generated can be examined in detail by again referring to FIG. 3 and the waveforms in FIG. 4A-4D. The portion of the circuitry designated as 55 in FIG. 3 is a diode clamping network. The purpose of this network is to clamp the signal at point 25 at a small positive potential near the end of the positive half-cycle of the AC power source and to clamp the signal at point 25 at a small negative potential near the end of the negative half-cycle of the power source. As explained above, this resets the output of the comparator to the proper state prior to the zero crossing of the power source. The AC power source is applied to the diode clamping network on lead 26. Capacitor C7, resistors R9 and R10, diodes D4 and D5, and resistors R11 and R12 form a phase shift network. By making resistors R11 and R12 of equal resistance, the voltage formed at point 56 is nearly sinusoidal but with a phase angle which is leading that of the AC power source and with an amplitude which is substantially less than that of the AC power source. During most of the positive half cycle of the voltage produced at point 56, diode D5 is conducting while diode D4 is back biased. Similarly, during most of the negative half cycle of the voltage produced at point 56, diode D4 is conducting and diode D5 is back biased. Hence the voltage produced at point 58 is nearly equal to the positive half cycle of the voltage at point 56, while the voltage produced at point 57 is nearly equal to the negative half cycle of the voltage produced at point 56 as shown in FIG. 4C.

As can be seen from FIG. 4C, the waveform at point 25 in the switching regions C-D-E and I-J-K is positive on the positive half cycle of the AC power source and negative on the negative half cycle of the AC power source. During most of the positive cycle of the AC power source, both diodes D6 and D7 are back biased; diode D7 being held in this state by the voltage at point 58 which is more positive than the voltage at point 25. Near the end of the positive half cycle of the power source, however, the voltage at point 58 becomes less positive than the voltage at point 25. At this time diode D7 conducts, discharging capacitor C8 through resistor R12 and clamping point 25 at a slightly positive potential with respect to circuit common; the value of this potential being equal to the forward drop of diode D7 plus the small voltage drop across resistor R12. Diode D7 is held in its conducting state since the potential at point 41 at this time is positive with respect to circuit common. Hence current flows from point 41 to circuit common through resistor R13, diode D7 and resistor R12. A similar clamping action occurs near the end of the negative half cycle of the AC power source. During most of the negative half cycle of the AC power source, both diodes D6 and D7 are back biased; diode D6 being held in this state by the voltage at point 57 which is more negative than the voltage at point 25. Near the end of the negative half cycle of the power source, the voltage at point 57 becomes less negative than the voltage at point 25. At this time diode D6 conducts, discharging capacitor C8 through resistor R11 and clamping point 25 at a slightly negative potential. Diode D6 is held in its conducting state since the voltage at point 41 is now negative with respect to circuit common. producing a current flow from circuit common through resistor R11, diode D6, and resistor R13 to point 41. Hence the circuit designated 55 in FIG. 3 establishes a fixed and repeatable set of initial conditions on capacitor C8 near the end of each half-cycle of the AC power source; such initial conditions being equal in magnitude and of the same polarity as the respective-half cycles of the power source.

The circuitry designated 69 in FIG. 3 is a wave shaping network for forming a portion of the waveform at point 25. The input to this network is the symmetrical square wave which appears at point 41. As previously explained, the voltage on capacitor C8 is clamped at a slightly negative potential with respect to circuit common at the beginning of the positive half-cycle of the power source. At point *b* in the cycle, the square wave at point 41 switches rapidly from a negative to a positive potential. At this point diode D6 becomes reversed biased ceasing to conduct, while diode D7 remains reverse biased by virtue of the positive voltage at point 58. The step change in the voltage at point 41 produces a similar step-like change in the voltage at point 25 by means of the proportional capacitive divider formed by capacitors C9 and C8. Resistor R14 introduces a time constant which produces a slight rounding in the region of point *c* which makes the regulator less sensitive to noise at low line voltages where the slope of the waveform at point 25 and the slope of output *b* of the voltage divider are nearly equal. Following this initial step change, capacitor C8 continues to charge through resistor R13, and the voltage at point 25 increases from point *c* toward point *e*. At point *e*, diode D7 conducts and the voltage at point 25 becomes clamped to the voltage at point 58. At point *f* in the cycle, diode D5 ceases to conduct and the voltage at point 25 becomes clamped at a slightly positive potential prior to the negative half-cycle of the power line. At point *h* in the cycle, the square wave at point 41 switches from positive to negative. The step change in the voltage at point 41 again produces a step-like change in the voltage at point 25, this time in the negative direction from point *h* to point *i* on the waveform. Of course, the same rounding effect is also introduced on the negative half cycle in the region of point *i*. Following the step change, capacitor C8 continues to charge through resistor R13 and the voltage at point 25 increases in the negative direction from point *i* toward point *k*. At point *k* diode D6 conducts, and the voltage at point 25 becomes clamped to the voltage at point 57. At point *i*, diode D4 ceases to conduct and the voltage at point 25 becomes clamped at a slightly negative potential prior to the positive half cycle of the AC power source.

Potentiometer P2 and capacitor C10 provide a means for adjusting the magnitude of the initial step in the regions *b-c*, and *h-i*. The two ends of potentiometer P2 are connected to point 41 and to circuit common so that a square wave appears at the slider of potentiometer P2. By varying the position of the slider of potentiometer P2, the amplitude of the square wave appearing at the slider can be varied. The voltage appearing at the slider of potentiometer P2 is applied to one end of capacitor C10, the other end of capacitor C10 being connected to one end of capacitor C9. As will be appreciated by those skilled in the art, varying potentiometer P2 has nearly the same effect as placing more or less capacitance in parallel with capacitor C9. Since this changes the voltage ratio of the capacitor divider formed with capacitor C8, it follows that the magnitude of the step-like change occurring in regions *b-c* and *h-i* may be adjusted by means of potentiometer P2.

In the regions *c-d-e* and *i-j-k*, capacitor C8 is charging through resistor R13. Without further compensation, this charging action would produce an exponential function which is somewhat nonlinear. As was stated previously, the ideal switching curve in this region is a nearly linear ramp, and nonlinearities in this function will produce errors in the regulation characteristic. To avoid this, linearity compensation is introduced via resistor R15 which is connected between point 54 and point 25. Resistor R15 is of relatively high impedance compared to the impedance at points 54 and 25. Thus, the component of voltage introduced at point 25 by virtue of resistor R15 is quite small compared to the voltage at point 54, but also is lagging this voltage by approximately 90°. This waveform is illustrated in FIG. 4D. It should be noted that the waveform has a slope which is increasing in the positive direction in the region *c-d-e*, and a slope which is increasing in the negative direction in the region *i-j-k*. This is, of course, opposite from the exponential function produced by the charging of capacitor C8 through resistor R13 which exhibits a slope which is decreasing in the positive direction in the region *c-d-e*, and a slope which is decreasing in the negative direction in the region *i-j-k*. By establishing the proper phase and amplitude of the component of voltage introduced at point 25 by resistor R15, a portion of the sine wave curve which has curvature nearly opposite from the curvature of the normal exponential produced can be obtained; and the voltage at point 25 in the regions *c-d-e* and *i-j-k* can be made substantially linear. Thus this waveform in combination with other waveforms previously described produces a constant voltage at the output terminals 12 and 13 even though the amplitude of the AC power source varies over a wide range.

In order to discuss other aspects of the root mean square voltage regulator, it is important to describe the effects of varying the amplitude of the square wave appearing at point 41. Referring again to FIG. 4C, it is apparent that if the amplitude of the signal at point 41 is reduced that the amplitude of the initial step in the regions *b-c* and *h-i* will be proportionately reduced. Also the slope of the ramp in regions *c-d-e* and *i-j-k* will likewise be proportionately reduced. Referring now to FIG. 2A, it is apparent that both of these changes act to shift the switching points D and J to the right so that the triac is triggered at a later point in each half cycle. Thus reducing the amplitude of the signal at point 41 reduces the output RMS voltage appearing at terminals 12 and 13 and vice versa.

As stated previously, potentiometer P2 varies the magnitude of the initial step in the regions *c-d* and *h-i* in FIG. 4C. Potentiometer P1, on the other hand, varies the amplitude of the square wave at point 41 which in turn varies the magnitude of the initial step in regions *b-c* and *h-i* and also the slope in the linear switching regions *c-d-e* and *i-j-k*. Thus by adjusting both of these potentiometers, both the magnitude of the initial steps and the slope of the linear portions of the waveform can be adjusted. In this manner, the regulator can be readily calibrated to produce nearly perfect regulation over a wide range of amplitude of the AC power source.

It is apparent from previous discussion that, once the regulator output has reached its steady state value following an initial turn on of power, the regulator responds to changes in the AC power source vary rapidly, that is within one-half cycle of the power source. However, it is desirable that the output voltage build up more gradually during the period directly following the initial turn on of power.

Prior to the initial turn on of power, capacitors C4 and C5 are fully discharged. When power is then applied to the regulator, capacitors C4 and C5 charge relatively slowly on alternate half cycles of the AC power source through resistors R4 and R5. During this initial charging period, transistor Q1 is not conducting and there is no regulating action occurring in the power supply. Capacitors C4 and C5 continue to charge until the voltage across them is sufficient to cause the transistor to conduct. At this point, the previously described regulation action of transistor Q1 in combination with other circuit elements begins and continues as long as power is applied to the regulator. When power is removed from the regulator, capacitors C4 and C5 are quickly discharged through the load formed by comparator 16 and are ready for the next power turn on.

Because of the alternate clamping action of diodes D1 and D2, the amplitude of the square wave will follow the DC voltages on leads 34 and 35, and will also build up relatively slowly following an initial power turn on. This in turn causes the output voltage of the regulator to build up relatively slowly following a power turn on in a manner previously described.

The rate at which the regulator output voltage builds up following an initial power turn on is a function of the values of resistors R4 and R5 and capacitors C4 and C5. Obviously these values can be chosen so that the build up characteristics of the regulator act to prevent current surges or act to produce other desired effects with particular loads, such as compensating for the effects of thermal time constants and the like.

Thus it can be seen that the objects of the invention have been met by the circuitry described in detail with particular reference to a preferred embodiment, it will be understood that variations and modifications can be made without departing from the spirit and scope of this invention. For instance, the waveform illustrated in FIG. 2A may be generated by a variety of different circuits including those employing operational amplifiers. Also, rather than interrupt each half-cycle of the AC source, the triac could be triggered so as to interrupt the line current at the start of each full cycle. Such a regulator would have a correspondingly slower response to changes in the RMS value of the source. This and many other modifications of the disclosed circuit will be apparent to those skilled in the art, and this invention includes all modifications falling within the scope of the following claims.

I claim:

1. A voltage regulator for maintaining at a substantially constant level the RMS voltage supplied to a load from an AC voltage source having a sinusoidal waveform and a varying peak-to-peak amplitude, said regulator comprising:

(a) a waveform generator circuit for generating a predetermined, time varying waveform, of predetermined period, said period being identical to that of the sinusoidal waveforms characteristic of the AC source;

(b) a comparator circuit for comparing the waveform of said waveform generator with the sinusoidal waveform of the AC source, said comparator circuit having an output voltage which changes polarity in response to a change in sign of the algebraic difference between the waveform of said waveform generator and the sinusoidal waveform of the AC source; and (c) a switching circuit coupled to said comparator circuit and the AC source for interrupting the output of the AC source at the beginning of each cycle for a predetermined time interval proportional to the time required for the output of said comparator circuit to change polarity immediately after the start of each cycle of the sinusoidal waveform of the AC source.

2. The voltage regulator of claim 1 wherein said switching circuit interrupts the output of the AC at the beginning of each half-cycle.

3. The voltage regulator of claim 1 wherein said switching circuit comprises a triac.

4. The voltage regulator of claim 3 wherein the output of said waveform generator circuit is such as to cause said triac to trigger in the first half of each half-cycle of the AC source.

5. The voltage regulator of claim 1 wherein said comparator circuit comprises an operational amplifier.

6. The voltage regulator of claim 1 wherein said predetermined, time varying waveform is a bipolarity waveform.

7. A voltage regulator for maintaining at a substantially constant value the RMS voltage applied to a load from an AC power source having a sinusoidal waveform, such source having an RMS value which varies within a predefined range of values, all of such values exceeding said substantially constant value, said regulator comprising:

(a) a waveform generator for generating a predetermined periodic waveform a portion of which intersects each sinusoidal waveform of a family of sinusoidal waveforms representative of the variations of the RMS power source voltage within said predefined range at a point corresponding to the phase angle at which, if the power applied to the load were to be interrupted during such phase angle at the start of each half-cycle of the power source, the RMS voltage applied to the load would be equal to said substantially constant value, (b) a comparator circuit connected to said waveform generator and the power source for comparing said periodic waveform with the sinusoidal waveform characteristic of the instantaneous RMS voltage of the power source to generate a signal each time the instantaneous algebraic difference of said waveforms first changes sign after the start of each cycle of the power source; and (c) a switching circuit coupled to said comparator circuit and the power source for interrupting the output of the power source at the start of each cycle until said signal is received from said comparator.

8. The voltage regulator of claim 7 wherein said switching circuit interrupts the output of the AC at the beginning of each half-cycle.

9. The voltage regulator of claim 7 wherein said switching circuit comprises a triac.

10. The voltage regulator of claim 7 wherein said comparator circuit comprises an operational amplifier.

11. The voltage regulator of claim 7 wherein said predetermined, time varying waveform is a bipolarity waveform.

12. The voltage regulator of claim 7 wherein said portion of said periodic waveform is a substantially linear ramp function.

13. The voltage regulator of claim 12 wherein said waveform generator comprises means for gradually increasing the slope of said ramp function following the initial application of power to the load from zero to a value at which steady-state regulation of the RMS voltage to the load is achieved, whereby a gradual increase in voltage to the load is effected.

14. A method for maintaining at a substantially constant value the RMS voltage applied to a load from an AC power source having an instantaneous RMS value which varies within a predefined range of values, such range exceeding such constant value, the AC power source having a substantailly sinusoidal waveform, said method comprising the steps of:

(a) generating a periodic waveform a portion of which intersects each sinusoidal waveform of a family of sinusoidal waveforms representative of the variations of the RMS power source voltage within said predefined range at a point corresponding to the phase angle at which, if the power applied to the load were to be interrupted for such phase angle at the start of each half-cycle of the power source, the RMS voltage applied to the load would have saic substantially constant value;

(b) comparing said periodic waveform with the sinusoidal waveform characteristic of the instantaneous RMS voltage of the power source to generate a signal each time the algebraic difference of said waveforms changes sign following the start of each cycle of said power source;

(c) utilizing said signal to trigger a phasecontrolling switch which controls the RMS voltage applied to the load by interrupting the power applied to the load at the start of each cycle of said power source until said signal is received by said switch.

15. The method of claim 14 wherein said signal is utilized to interrupt the power applied to the load at the start of each half-cycle of said power source.

16. A method for maintaining at a substantially constant value the RMS voltage applied to a load from an AC power source of sinusoidal waveform, such power source having an RMS value which varies within a predetermined range of values, said method comprising the steps of:

(a) generating a predetermined bipolarity waveform having a period corresponding to the period of said sinusoidal waveform;

(b) comparing said bipolarity waveform with the sinusoidal waveform characteristic of the instantaneous RMS voltage of the source to produce a signal each time the instantaneous algebraic difference of said waveforms first changes sign after the start of each cycle of said sinusoidal waveform; and (c) utilizing said signal to trigger a phase-controlling switch which controls the RMS voltage applied to the load by interrupting the power applied to the load at the start of each cycle of said power source until said signal is received by said switch.

17. The method of claim 16 wherein said signal is utilized to interrupt the power applied to the load at the start of each half-cycle of said power source.

* * * * *